United States Patent [19]

Wegman et al.

[11] Patent Number: 5,019,332

[45] **Date of Patent: * May 28, 1991**

[54] HEAT, CORROSION, AND WEAR RESISTANT STEEL ALLOY

[75] Inventors: Dwight D. Wegman, Oley; Edward A. Wanner, Leesport; Wilson P. Rehrer, Reading; Sunil Widge, Dryville, all of Pa.

[73] Assignee: Carpenter Technology Corporation, Reading, Pa.

[ * ] Notice: The portion of the term of this patent subsequent to May 29, 2007 has been disclaimed.

[21] Appl. No.: 515,107

[22] Filed: Apr. 27, 1990

Related U.S. Application Data

[63] Continuation of Ser. No. 168,924, Mar. 16, 1988, Pat. No. 4,929,419.

[51] Int. Cl.[5] ..... C22C 38/46

[52] U.S. Cl. ..... 420/59; 420/56; 420/57; 420/47; 420/48

[58] Field of Search ..... 420/56, 57, 47, 48, 420/59, 584; 148/326, 327, 419

[56] References Cited

U.S. PATENT DOCUMENTS 4,824,636 4/1989 Vacchiano et al. ..... 420/57
4,929,419 5/1990 Wegman et al. ..... 420/56

*Primary Examiner*—Deborah Yee
*Attorney, Agent, or Firm*—Dann, Dorfman, Herrell and Skillman

[57] ABSTRACT

A heat, corrosion and wear resistant austenitic steel and article made therefrom is disclosed containing in weight percent about

| | w/o |
|---|---|
| Carbon | 0.35–1.50 |
| Manganese | 3.0–10.0 |
| Silicon | 2.0 max. |
| Phosphorus | 0.10 max. |
| Sulfur | 0.05 max. |
| Chromium | 18–28 |
| Nickel | 3.0–10.0 |
| Molybdenum | Up to 10.0 |
| Vanadium | Up to 4.0 |
| Boron | Up to 0.03 |
| Nitrogen | 0.25 min. |
| Tungsten | Up to 8.0 |
| Niobium | 1.0 max. |

the balance being essentially iron. To attain the unique combination of properties provided by the present alloy w/o C+w/o N must be at least about 0.7, w/o V+0.5 (w/o Mo)+0.25 (w/o W) must be about 0.8–9.0.

20 Claims, No Drawings

HEAT, CORROSION, AND WEAR RESISTANT STEEL ALLOY

This is a continuation of application Ser. No. 07/168,924 filed Mar. 16, 1988, now U.S. Pat. No. 4,929,419.

BACKGROUND OF THE INVENTION

This invention relates to an austenitic, corrosion resistant steel alloy and in particular to such an alloy and articles made therefrom having good high temperature strength in combination with good wear resistance.

Efforts to improve the performance and durability of internal combustion engines have resulted in a demand for materials which can withstand the corrosive, high temperature, and high stress conditions of such engines. Of the many components which make up modern day gasoline and diesel engines, the exhaust valves are subjected to all of the foregoing conditions when in use. Among the properties desired of materials for fabricating exhaust valves for high performance, heavy duty, internal combustion engines are good high temperature strength and hardness, resistance to oxidation and hot corrosion, good wear resistance and good formability.

U.S. Pat. No. 3,969,109 granted July 12, 1976 to H. Tanczyn relates to an austenitic stainless steel having the following composition in weight percent (w/o). Here and throughout this application, percent will be by weight unless otherwise indicated.

| Element | w/o |
|---|---|
| C | 0.20–0.50 |
| Mn | 0.01–3.0 |
| Si | 2 max. |
| P | 0.10 max. |
| S | 0.40 max. |
| Cr | 18–35 |
| Ni | 0.01–15 |
| N | 0.30–1.0 |
| Fe | Balance |

Included with the balance are the usual incidental amounts of other elements present in commercial grades of such steels. Tanczyn also suggests that up to 4 w/o molybdenum, or up to 3% tungsten can be added to the alloy. Tanczyn further states that columbium and/or vanadium may be added to the alloy in amounts up to 2% total The alloy which is described in the Tanczyn patent has been used to make exhaust valves for high performance, heavy duty automotive engines.

An alloy designated as "23-8N" has been sold containing about 0.28–0.38% C, 1.5–3.5% Mn, 0.5–1.0% Si, 0.04% max. P, 0.03% max. S, 22.0–24.0% Cr, 7.0–9.0% Ni, 0.25–0.40% N, and the balance of essentially iron. "23-8N" alloy leaves something to be desired, however, with respect to wear resistance. Under severe service conditions, exhaust valves formed from the 23-8N alloy are subject to undesirable wear due to the metal-to-metal contact between the valve head and seat unless hard faced to obtain better wear resistance.

U.S. Pat. No. 3,561,953, granted Feb. 9, 1971 to I. Niimi et al. relates to an austenitic steel alloy containing nickel, chromium, manganese, molybdenum and vanadium. The broad range of the alloy described in Niimi et al. is as follows:

| Element | w/o |
|---|---|
| C | 0.1–0.6 |
| Mn | 3.0–15.0 |
| Si | 0.1–2.0 |
| Cr | 15.0–28.0 |
| Ni | 1.0–15.0 |
| Mo | 0.01–1.5 |
| V | 0.01–1.5 |
| N | 0.2–0.6 |
| W | 0.01–2.0 |
| Cb | 0.01–1.5 |
| Ca | 0.001–0.020 |
| O | <0.008 |
| Fe | Balance |

The balance includes usual amounts of incidental elements present in commercial grades of such steels. Niimi et al states that the alloy is "for engine valves and similar applications". However, Niimi et al. does not address the problem of adhesive wear resistance in automotive exhaust valves. Furthermore, Niimi et al. states that Y and Mo adversely affect the hot workability of the alloy. Niimi et al. is directed to an alloy in which oxygen content is severely limited and which relies on the use of a small amount of calcium to improve the hot workability of the alloy.

U.S. Pat. No. 3,366,472 granted on Jan. 30, 1968 to H. Tanczyn et al. relates to an austenitic stainless steel alloy containing chromium, nickel, manganese, vanadium, carbon and nitrogen. The broad compositional range of the alloy described in Tanczyn et al. is as follows:

| Element | w/o Range |
|---|---|
| C | 0.20–1.50 |
| Mn | 0.01–16.00 |
| Si | 1.25 max. |
| P | 0.050 max. |
| S | 0.35 max. |
| Cr | 12–30 |
| Ni | 0.01–7 |
| Mo | 4.00 max. |
| V | 0.50–2.00 |
| N | 0.15–0.75 |
| B | Up to 0.005 |
| W | 4.00 max. |
| Cb | 1.50 max. |
| Cu | 4.00 max. |
| Fe | Balance |

and in which the sum of w/o nickel and w/o manganese must be at least 6%. Included with the balance are the usual amounts of other elements present in commercial grades of such steels. The alloy described in the Tanczyn et al. patent is indicated as being heat hardenable and to have high strength at both room and elevated temperatures in both the solution treated and age-hardened condition, although only room temperature strength is indicated. However, the alloy of Tanczyn et al. is believed to provide less than desirable hardness and wear resistance at elevated temperatures.

SUMMARY OF THE INVENTION

In accordance with this invention, a precipitation strengthenable, austenitic steel alloy and article made therefrom, are provided having mechanical properties and corrosion resistance properties comparable to 23-8N but with improved heat resistance and elevated temperature wear resistance. The alloy of this invention consists essentially of, in weight percent, about:

| | Broad | Intermediate | Preferred |
|---|---|---|---|
| C | 1.50 max. | 0.35–0.90 | 0.40–0.80 |
| Mn | 3.0–10.0 | 4.0–8.5 | 4.5–8.0 |
| Si | 2.0 max. | 0.75 max. | 0.50 max. |
| Cr | 18–28 | 19.0–25.0 | 20.0–24.0 |
| Ni | 3.0–10.0 | 4.5–8.5 | 5.0–8.5 |
| Mo | Up to 10.0 | Up to 8.0 | 0.5 max. |
| V | Up to 4.0 | 0.5–3.5 | 0.75–3.0 |
| B | Up to 0.03 | Up to 0.02 | 0.001–0.015 |
| N | 1.0 max. | 0.25–0.85 | 0.35–0.75 |
| W | Up to 8.0 | Up to 6.0 | 0.5 max. |
| Fe | Bal. | Bal. | Bal. |

Included with the balance (Bal.) are incidental impurities and additions which do not detract from the desired properties. For example, up to about 0.10 w/o, preferably 0.05 w/o max. phosphorus; up to about 0.05 w/o, preferably 0.015 w/o max. sulfur; and up to about 1.0 max. w/o, better yet no more than about 0.85 w/o, and preferably about 0.5 w/o max. niobium can be present. Up to about 0.05 w/o aluminum and up to about 0.01 w/o of each of the elements calcium and magnesium can be present as residuals from deoxidizing and/or desulfurizing additions. varying amounts of titanium and/or zirconium may also be present in stoichiometric proportions as additional carbide, nitride and carbonitride forming elements.

The foregoing tabulation is provided as a convenient summary and is not intended thereby to restrict the lower and upper values of the ranges of the individual elements of the alloy of this invention for use solely in combination with each other or to restrict the broad, intermediate or preferred ranges of the elements for use solely in combination with each other. Thus, one or more of the broad, intermediate and preferred ranges can be used with one or more of the other ranges for the remaining elements. In addition, a broad, intermediate or preferred minimum or maximum for an element can be used with the maximum or minimum for that element from one of the remaining ranges.

In the iron base steel alloy of this invention carbon, nitrogen, vanadium and molybdenum are critically balanced to provide improved high temperature strength and wear resistance with a substantially austenitic microstructure. In this regard w/o C+w/o N must be at least about 0.7, preferably at least about 0.8 and w/o V+0.5 (w/o Mo)+0.25 (w/o W) must be about 0.8–9.0, preferably about 1.0–6.0. In order to provide the best properties the alloy is balanced in accordance with the following relationships:

$$(w/o\ C + w/o\ N) \geqq [.65 + .15\ (w/o\ V) + .04\ (w/o\ Mo + 0.5\ (w/o\ W))], \text{ and}$$

$$(w/o\ C + w/o\ N) \leqq [.65 + .38\ (w/o\ V) + 0.08\ (w/o\ Mo + 0.5\ (w/o\ W))].$$

Additionally, w/o Mn+w/o Ni is about 6.0–16.0 and preferably about 10.00–15.00 to ensure an essentially austenitic structure.

DETAILED DESCRIPTION OF THE INVENTION

Vanadium and molybdenum, either individually or in combination, work to provide the desired high hardness, strength and wear resistance characteristic of this alloy at both room and elevated temperatures. To this end the amounts of vanadium and molybdenum when either or both are present are controlled so that the relationship $0.8 \leqq$ w/o V+0.5 (w/o Mo)$\leqq 9.0$ is satisfied. Excessive amounts of either or both of vanadium and molybdenum adversely affect the hot workability of the alloy, promote the formation of undesirable ferrite, and, at elevated temperatures promote the formation of undesirable secondary phases such as sigma and/or chi phase. Accordingly, vanadium is limited to no more than about 4.0 w/o better yet to about 3.5 w/o max., and preferably to about 3.0 w/o max. Preferably, at least about 0.5%, better yet at least about 0.75% vanadium is present. For best results about 1.0–2.5% vanadium should be present. While up to about 10.0 w/o molybdenum can be present, it is better to limit molybdenum to no more than about 8.0 w/o. Best results are attained when the amount of molybdenum present is less than about 0.5 w/o. The sum of w/o V+0.5 (w/o Mo) is advantageously limited to about 1.0–6.0.

Within the stated ranges for the alloy according to this invention, tungsten can be substituted for up to one-half of the w/o Mo in excess of 1.0 w/o in the ratio 2 w/o W:1 w/o Mo. When present, tungsten is limited to no more than about 8.0 w/o and better yet to about 6.0 w/o max. because excessive amounts of tungsten promote the formation of undesirable sigma phase and needlessly increase the cost of the alloy. When tungsten is present in the alloy, the amounts of vanadium, molybdenum and tungsten are controlled so that the relationship $0.8 \leqq$ w/o V+0.5 (w/o Mo)+0.25 (w/o W)$\leqq 9.0$ is satisfied. Preferably, the sum w/o V+0.5 (w/o Mo)+0.25 (w/o W) is limited to about 1.0–6.0. When less than about 1.0 w/o molybdenum is present in the alloy, tungsten is limited to no more than about 0.5 w/o max., preferably to no more than about 0.2 w/o max.

Carbon and nitrogen are present in this alloy to provide the desired hardness and strength through solid solution strengthening and by combining with chromium, vanadium and molybdenum to form carbides, nitrides and carbonitrides during heat treatment. These hard phases benefit the high temperature strength and the wear resistance of the alloy. Accordingly, up to about 1.50 w/o, preferably up to about 0.90 w/o, carbon can be present for cast products, whereas a maximum of about 0.80 w/o, preferably about 0.70 w/o max. carbon should be observed for wrought products to avoid excessive loss in hot workability. Preferably, a minimum of about 0.35 w/o, better yet at least about 0.40 w/o, carbon is present in the alloy. For best results, at least about 0.45 w/o carbon should be present.

While up to about 1.0 w/o nitrogen can be present in this alloy when made with powder metallurgy processes, cast or wrought forms can contain nitrogen up to its solubility limit but not more than about 0.85 w/o, better yet not more than about 0.75 w/o to avoid excessive loss in hot workability. For best results nitrogen is limited to no more than 0.65 w/o. At least about 0.25 w/o, preferably at least about 0.35 w/o, nitrogen is present in the alloy to provide good elevated temperature stress rupture ductility and the high elevated temperature strength and ductility which are characteristic of the alloy. For best results at least about 0.45 w/o nitrogen should be present. Carbon and nitrogen can substitute for each other as interstitial solid solution strengthening agents. Additionally, carbon and nitrogen can substitute for each other in the formation of hard phase precipitates such as $Cr_{23}(C,N)_6$, $Mo_2(C,N)$, and V(C,N). The desired properties previously described are readily provided by the present alloy when the sum (w/o C+w/o N) is at least about 0.7, and preferably at least about 0.8.

In order to obtain the best properties carbon, nitrogen, vanadium and molybdenum, and tungsten when present, are critically balanced in this alloy. Thus, for best results, the alloy should be balanced in accordance with the following relationship:

$$(w/o\ C + w/o\ N) \geqq [0.65 + 0.15\ (w/o\ V) + 0.04\ (w/o\ Mo + 0.5\ (w/o\ W))] \quad (1)$$

$$(w/o\ C + w/o\ N) \leqq [0.65 + 0.38\ (w/o\ V) + 0.08\ (w/o\ Mo + 0.5\ (w/o\ W))] \quad (2)$$

The alloy of the present invention is preferably fully austenitic at room and elevated temperatures in the solution treated and age hardened condition. A small amount of ferrite, however, can be tolerated which does not objectionably impair the hot workability of the alloy and/or the desired properties, for example, wear resistance, for a given application. In this regard ferrite is limited to no more than about 5 v/o (volume percent), better yet to not more than about 1 v/o max.

Nickel is important in the alloy because it promotes the formation of austenite. To this end at least about 3.0 w/o, better yet at least about 4.5 w/o, and preferably at least about 5.0 w/o nickel is present. A fully austenitic microstructure is assured with at least about 6.0 w/o nickel present. Nickel is limited to about 10.0 w/o max., preferably up to about 8.5 w/o max., because excessive nickel adversely affects the sulfidation resistance of the alloy.

A minimum of about 3.0 w/o, better yet at least about 4.0 w/o., and preferably at least about 4.5 w/o manganese is present in the alloy because it contributes to increased solubility of nitrogen in the matrix. Too much manganese adversely affects the oxidation resistance of the alloy and needlessly increases the cost of the alloy without providing any additional benefit. Accordingly, manganese is limited to a maximum of about 10.0 w/o, better yet to about 8.5 w/o max., and preferably to about 8.0 w/o max. For best results manganese is kept within the range 5.0–7.5 w/o.

Manganese can be substituted for nickel as an austenite stabilizer within the aforesaid ranges. Accordingly, the sum of the weight percents of manganese and nickel in the alloy is about 6.0–16.0 w/o, and preferably about 10.00–15.00 w/o.

A minimum of about 18 w/o, better yet at least about 19.0 w/o, and preferably at least about 20.0 w/o, chromium is present in the alloy to provide good resistance to oxidation and hot corrosion. Chromium is beneficial to the hot hardness of the alloy because it provides solid solution strengthening. It also combines with carbon and/or nitrogen as discussed hereinabove, to form chromium carbides and nitrides which are beneficial to the wear resistance of the alloy. Chromium is limited to a maximum of about 28 w/o, better yet to no more than about 25.0 w/o, and preferably to about 24.0 w/o max., because it promotes formation of undesirable ferrite and secondary phases, such as sigma phase. Best results are provided with chromium in the range 21.0–23.5 w/o.

Up to about 2.0 w/o max. silicon can be present in this alloy when prepared as cast product. However, for the wrought product silicon is limited to about 0.75 w/o max. When present silicon improves the retention of oxide scale on in-service parts fabricated from the present alloy. Preferably silicon is limited to no more than about 0.50 w/o max. for good resistance to hot corrosion in environments containing lead oxide.

A small but effective amount of boron, up to about 0.03 w/o, better yet up to about 0.02 w/o, is present in this alloy. When present, this small amount of boron is believed to prevent the precipitation of undesirable phases in the grain boundaries and also to improve stress rupture life and ductility. For best results about 0.001–0.015 w/o boron is preferred.

Other elements may be present in the alloy as incidental amounts or as residuals as a result of the melting practice utilized. In this regard up to about 0.05 w/o max. aluminum, up to about 0.01 w/o max. calcium, and up to about 0.01 w/o max. magnesium can be present as residuals from deoxidizing and/or desulfurizing additions. Niobium is limited to about 1.0 w/o max., better yet to no more than about 0.85 w/o, and preferably to about 0.2 w/o max., because it adversely affects the aging response and hot hardness of the alloy. Varying amounts of titanium and/or zirconium may also be present in stoichiometric proportions as additional carbide, nitride and carbonitride forming elements.

The balance of the alloy according to the present invention is iron except for the usual impurities found in commercial grades of alloys provided for the intended service or use. However, the levels of such impurity elements must be controlled so as not to adversely affect the desired properties of the present alloy. In this regard phosphorus is limited to about 0.10 w/o max., preferably to about 0.05 w/o max. sulfur is limited to about 0.05 w/o max., preferably to about 0.015 w/o max.

The alloy of this invention can be prepared using conventional practices. The preferred commercial practice is to prepare a heat using the electric arc furnace and refine it using the known argon-oxygen decarburization practice (AOD). When additional refining is desired the heat is cast into the form of electrodes. The electrodes are remelted in an electroslag remelting (ESR) furnace and recast into ingots. The alloy is readily hot worked from a furnace temperature of about 2000°–2250° F. and air cooled. Articles and parts are readily fabricated from the alloy by such hot working techniques as hot extrusion, hot coining, hot forging and others from a furnace temperature of about 2050°–2150° F.

The alloy of the present invention is useful in a wide variety of applications, for example, automotive applications, including, but not limited to, exhaust valves, combustion chamber parts, shields for exhaust system oxygen sensors, and other parts exposed to elevated temperature corrosive environments. It is contemplated that the alloy could be utilized in other applications where high temperature, oxidizing and/or corrosive environments are encountered, for example, gas turbine and jet engine applications such as buckets and chambers. The present alloy is also suitable for use in a variety of forms such as bars, billets, wire, strip, and sheet.

The alloy is preferably solution treated prior to hardening. Solution treatment is carried out at a temperature low enough to avoid excessive grain growth, but sufficiently high to dissolve secondary carbides, i.e., those carbides, nitrides and carbonitrides for example, formed during the hot working operation and the cooling immediately subsequent thereto. Solution treatment is preferably carried out at about 2150°-2250° F. for about 1 hour followed by quenching to room temperature in air or water. Preferably the formation of coarse carbide and/or nitride precipitates during cooling is prevented by rapid quenching. Precipitation strengthening (i.e. age hardening) of an article formed from the alloy is preferably carried out by heating to about 1200°-1500° F. for about 4-8 hours, followed by cooling in air to room temperature. It is contemplated that an article formed from the present alloy can be aged while in service when used in a high temperature application such as internal combustion engines, where the operating temperature is substantially within the temperature range 1000°-1500° F. Parts can be readily finish machined in the precipitation strengthened condition.

For purposes of illustration 15 small experimental heats of the alloy of the present invention and a small heat of the 23-8N alloy were vacuum induction melted with the final additions of nitrogen and manganese being made under an inert atmosphere. The heats were cast into 2.75 in square ingots, homogenized at 2150° F. for 16 hours, and then stabilized at 2050° F. Thereafter, the ingots were forged into 1.125 in square and 0.75 in square bars. The compositions of the heats are set forth in Table I.

TABLE I

| Ex. | C | Mn | Si | P | S | Cr | Ni | Mo | V | B | N |
|---|---|---|---|---|---|---|---|---|---|---|---|
| 1 | 0.39 | 5.91 | 0.27 | 0.025 | 0.006 | 22.00 | 7.50 | 0.20 | 1.20 | 0.004 | 0.55 |
| 2 | 0 52 | 6.20 | 0.29 | 0.023 | 0.005 | 22.15 | 7.50 | 0.20 | 1.24 | 0.004 | 0.42 |
| 3 | 0.51 | 6.11 | 0.26 | 0.016 | 0.007 | 22.39 | 7.48 | 0.21 | 1.39 | 0.005 | 0.54 |
| 4 | 0.69 | 6.05 | 0.28 | 0.026 | 0.005 | 21.98 | 7.48 | 0.21 | 1.62 | 0.004 | 0.58 |
| 5 | 0.38 | 6.17 | 0.29 | 0.028 | 0.005 | 22.10 | 7.55 | 0.20 | 1.71 | 0.004 | 0.55 |
| 6 | 0.52 | 6.10 | 0.29 | 0.025 | 0.005 | 22.05 | 7.54 | 0.20 | 1.79 | 0.004 | 0.50 |
| 7 | 0.69 | 5.94 | 0.28 | 0.026 | 0.005 | 22.07 | 7.43 | 0.19 | 2.31 | 0.004 | 0.56 |
| 8 | 0.52 | 7.11 | 0.30 | 0.026 | 0.006 | 21.95 | 7.58 | 0.20 | 2.35 | 0.004 | 0.56 |
| 9 | 0.68 | 6.82 | 0.29 | 0.022 | 0.006 | 22.14 | 7.49 | 0.20 | 2.77 | 0.004 | 0.58 |
| 10 | 0.39 | 6.19 | 0.29 | 0.026 | 0.006 | 22.21 | 7.41 | 2.21 | 0.10 | 0.005 | 0.40 |
| 11 | 0.54 | 5.89 | 0.30 | 0.029 | 0.005 | 22.12 | 7.46 | 4.46 | 0.10 | 0.004 | 0.42 |
| 12 | 0.51 | 6.21 | 0.27 | 0.021 | 0.006 | 22.01 | 7.72 | 5.17 | 0.13 | 0.006 | 0.53 |
| 13 | 0.68 | 5.90 | 0.29 | 0.028 | 0.005 | 22.11 | 7.54 | 6.41 | 0.15 | 0.004 | 0.44 |
| 14 | 0.51 | 6.16 | 0.29 | 0.021 | 0.007 | 22.15 | 7.63 | 2.64 | 0.65 | 0.005 | 0.52 |
| 15 | 0.52 | 5.91 | 0.28 | 0.020 | 0.006 | 22.24 | 7.44 | 2.43 | 0.12 | <0.005 | 0.48 |
| 23-8N | 0.35 | 3.28 | 0.72 | 0.020 | 0.006 | 22.08 | 7.46 | 0.21 | 0.12 | 0.005 | 0.32 |

Example 15 includes 5.14% W. The balance of each composition was essentially iron.

Lengths of the 0.75 in square bars of each heat were solution treated as indicated in Table II and machined to rough dimension for standard A.S.T.M. subsize smooth bar tensile and stress rupture specimens. The rough specimens were then age-hardened as indicated in Table II and then machined to finish size.

TABLE II*

| Ex. | Sol. Temp (°F.) | Aging Temp. (°F.) |
|---|---|---|
| 1 | 2250 | 1450 |
| 2 | 2250 | 1350 |
| 3 | 2170 | 1400 |
| 4 | 2250 | 1300 |
| 5 | 2170 | 1300 |
| 6 | 2250 | 1350 |
| 7 | 2250 | 1300 |
| 8 | 2250 | 1350 |
| 9 | 2250 | 1300 |
| 10 | 2170 | 1500 |
| 11 | 2225 | 1400 |
| 12 | 2170 | 1400 |
| 13 | 2225 | 1500 |
| 14 | 2170 | 1500 |
| 15 | 2170 | 1500 |

TABLE II*-continued

| Ex. | Sol. Temp (°F.) | Aging Temp. (°F.) |
|---|---|---|
| 23-8N | 2170 | 1500 |

*In all cases solution (Sol.) treatment was carried out for 1 hour followed by water quenching. Aging was carried out for 8 hours followed by cooling in air. The particular solution treatments and aging heat treatments were selected on the basis of solution studies and aging studies.

Results of room temperature and 1200° F. tensile tests are shown in Table III, including the 0.2% offset yield strength (0.2% Y.S.) and ultimate tensile strength (U.T.S.), both in ksi, as well as the percent elongation (El. %) and the reduction in cross-sectional area (R.A. %).

TABLE III

| | Room Temp. | | | | 1200° F. | | | |
|---|---|---|---|---|---|---|---|---|
| Ex. | 0.2% Y.S. | U.T.S. | El. % | R.A. % | 0.2% Y.S. | U.T.S. | El. % | R.A. % |
| 1 | 126.2 | 174.5 | 7.6 | 9.6 | 86.9 | 103.0 | 6.8 | 12.4 |
| 2 | 148.2 | 184.9 | 9.4 | 10.8 | 115.1 | 124.0 | 3.5 | 5.5 |
| 3 | 111.7 | 163.6 | 10.6 | 10.7 | — | — | — | — |
| 4 | 153.7 | 184.0 | 8.7 | 13.6 | 120.9 | 129.3 | 3.4 | 7.6 |
| 5 | 138.6 | 178.5 | 19.4 | 22.2 | 105.3 | 118.7 | 7.8 | 19.9 |
| 6 | 149.8 | 182.7 | 7.2 | 6.6 | 118.3 | 125.4 | 3.4 | 5.7 |
| 7 | 157.8 | 184.6 | 4.7 | 7.3 | 120.1 | 129.4 | 4.2 | 8.8 |
| 8 | 147.1 | 180.0 | 6.8 | 6.5 | 111.5 | 120.0 | 3.4 | 5.9 |
| 9 | 156.2 | 185.1 | 6.3 | 8.7 | 124.5 | 131.7 | 4.3 | 8.5 |
| 10 | 97.3 | 141.9 | 11.6 | 11.5 | 57.4 | 91.5 | 16.4 | 21.1 |
| 11 | 121.0 | 179.9 | 8.5 | 13.1 | 77.9 | 108.0 | 13.6 | 26.8 |
| 12 | 117.5 | 174.4 | 6.8 | 7.0 | — | — | — | — |
| 13 | 122.6 | 177.4 | 2.5 | 3.9 | 81.5 | 117.7 | 10.3 | 16.7 |
| 14 | 93.1 | 150.5 | 9.7 | 9.6 | — | — | — | — |
| 15 | 95.7 | 151.7 | 9.4 | 9.3 | — | — | — | — |
| 23-8N | 93.6 | 151.3 | 24.8 | 25.3 | — | — | — | — |
| 23-8N* | 105.0 | 156.0 | 20.0 | 35.0 | 46.0 | 80.0 | 24.0 | 18.0 |

*Data presented in L. F. Jenkins et al., "The Development of a New Austenitic Stainless Steel Exhaust Valve Material", Soc. of Automotive Engrs. Tech. Paper Series; Paper No. 780245 (1978) for a nominal composition of 23-8N and shown here for comparison purposes.

Table III illustrates the high strength provided by the present alloy at both room and elevated temperatures and which at the elevated temperature of 1200° F. is significantly better than the 23-8N alloy.

Stress rupture testing was carried out on duplicate subsize smooth bar stress rupture specimens at 1300° F. by applying a constant load to generate an initial stress of 35 ksi. The results of the stress rupture tests are shown in Table IV as the average of duplicate tests, including time to failure (Rupt. Life) in hours (h), the percent elongation (% El.) and the reduction in cross-sectional area (% R.A.).

TABLE IV

| Ex. | Rupt. Life (h) | % El. | % R.A. |
|---|---|---|---|
| 1 | 273.3 | 4.1 | 3.6 |
| 2 | 624.0 | 2.6 | 0.8 (1) |
| 3 | 247.9 | 11.8 | 16.0 |
| 4 | 525.1 | 6.6 | 3.5 (2) |
| 5 | 273.9 | 10.4 | 16.7 |
| 6 | 626.1 | 3.3 | 0.0 (2) |
| 7 | 642.7 | 4.9 | 3.5 (3) |
| 8 | 401.9 | 4.7 | 4.7 (2) |
| 9 | 609.2 | 8.1 | 10.9 (2) |
| 10 | 343.7 | 36.3 | 43.7 (4) |
| 11 | 520.2 | 23.6 | 34.7 |
| 12 | 471.7 | 25.3 | 56.2 |
| 13 | 327.6 | 33.7 | 66.9 |
| 14 | 271.6 | 36.8 | 51.8 |
| 15 | 408.7 | 31.9 | 51.2 |
| 23-8N | 151.0 | 6.7 | 7.6 |

(1) One specimen broke at end; one specimen broke at punch mark.
(2) Both specimens broke at end.
(3) Both specimens broke at punch mark.
(4) One specimen broke at end.

Table IV illustrates the good stress rupture life of the present alloy which is significantly better than the 23-8N alloy.

Hot hardness testing was performed on samples of heats 2–4, 6, 7, 9, 12, 14, 15 and a sample of the 23-8N heat all of which were solution treated and aged in accordance with Table II above. The hot hardness specimens each measured about 0.39 in rd. x 0.195 in high and the surface of each specimen was polished to a 6 micron finish.

Hot hardness testing was performed using an Akashi Model AVK-HF hot hardness tester. Indentations were made using a 5 kg load, measured, and then converted to DPH hardness in accordance with the standard test procedures for the apparatus. For each specimen, up to six hardness measurements were made and recorded at room temperature, 1000° F., 1200° F., 1400° F., and 1500° F. Elevated temperature specimens were stabilized for five minutes before hardnesses were measured.

The results of the hot hardness tests shown in Table V as Vickers hardness numbers (HV) are the lowest and the highest (low/high) for each specimen at each test temperature.

TABLE V

| | HV | | | | |
|---|---|---|---|---|---|
| Ex. | R.T. | 1000° F. | 1200° F. | 1400° F. | 1500° F. |
| 2 | 412/435 | 313/325 | 280/329 | 268/280 | 241/249 |
| 3 | 396/423 | 274/293 | 251/268 | 221/244 | 208/225 |
| 4 | 412/429 | 303/329 | 293/306 | 260/271 | 232/241 |
| 6 | 407/423 | 303/317 | 293/313 | 268/280 | 232/246 |
| 7 | 423/435 | 306/353 | 296/345 | 271/289 | 241/251 |
| 9 | 412/435 | 321/336 | 303/321 | 274/313 | 241/251 |
| 12 | 362/391 | 227/262 | 223/244 | 210/216 | 203/227 |
| 14 | 345/362 | 216/227 | 195/216 | 193/206 | 165/180 |
| 15 | 362* | 249/268 | 229/241 | 208/223 | 201/221 |
| 23-8N | 332/362 | 199/212 | 190/197 | 168/183 | 156/175 |

*One R.T. reading taken for Ex. 15.

Table V illustrates the high hardness and good heat resistance of the present alloy. It is noted that the room temperature and elevated temperature hardness of present alloy is as good to significantly better than the 23-8N alloy. The data of Table V is also indicative of the improved wear resistance of the alloy as described more fully hereinbelow.

Wear testing was performed at 800° F. on specimens of Examples 3, 12, 15 and a specimen of the 23-8N alloy. Ring specimens were machined from blanks cut from the solution treated bars and aged in accordance with the heat treatments specified in Table II. The wear test was carried out by mating a ring specimen for a given example against AISI type M2 high speed steel with a load of 100 lbs and rotating the ring specimen at 100 rpm for one hour at 800° F. The results of the wear tests are shown in Table VI as the mass of material lost (Mass Loss) in milligrams (mg). The mass loss of each specimen was determined by taking the difference between weighings made before and after testing. A smaller mass loss indicates better wear resistance.

TABLE VI

| Ex. | Mass Loss (mg) |
|---|---|
| 3 | 4.3, 13.2 |
| 12 | 3.6, 4.3 |
| 15 | 0.4, 0.8 |
| 23-8N | 9.7, 12.6 |

Table VI illustrates the significantly better wear resistance of the present alloy overall in comparison with 23-8N although one of the weight loss values for Example 3 is higher.

It can be seen from the foregoing description and the accompanying examples, that the alloy according to the present invention provides a unique combination of room temperature and elevated temperature strength and excellent heat resistance well suited to a wide variety of uses. The alloy, because of its excellent elevated temperature wear resistance is especially advantageous for the fabrication of engine valves. The improved wear resistance of the alloy also makes it more economical to use than those alloys which must be hard faced to achieve comparable wear resistance.

The terms and expressions which have been employed are used as terms of description and not of limitation. There is no intention in the use of such terms and expressions of excluding any equivalents of the features shown and described, or portions thereof. It is recognized, however, that various modifications are possible within the scope of the invention claimed.

What is claimed is:

1. A precipitation strengthenable, austenitic steel alloy that provides a good combination of high temperature strength, corrosion resistance, and wear resistance, said alloy, in weight percent, consisting essentially of about

| | w/o |
|---|---|
| Carbon | 1.50 max. |
| Manganese | 3.0–10.0 |
| Silicon | 2.0 max. |
| Phosphorous | 0.10 max. |
| Sulfur | 0.05 max. |
| Chromium | 18–28 |
| Nickel | 4.5–10.0 |
| Molybdenum | 0.5 max. |
| Vanadium | 0.75–4.0 |
| Boron | Up to 0.03 |
| Nitrogen | 1.0 max. |
| Tungsten | 0.5 max. |
| Niobium | 0.5 max. |

and the balance essentially Iron, wherein $$\%C+\%N \geqq 0.65+0.15(\%V)+0.04[(\%Mo)+0.5(\%W)],$$

and $\%C+\%N \leqq 0.65+0.38(V)+0.08[(\%Mo)+0.5(\%W)]$.

2. The alloy set forth in claim 1 containing at least about 0.35 w/o carbon.

3. The alloy set forth in claim 2 containing at least about 0.25 w/o nitrogen.

4. The alloy set forth in claim 3 containing at least about 0.35 w/o nitrogen.

5. The alloy set forth in claim 1 containing not more than about 8.5 w/o manganese.

6. The alloy set forth in claim 5 containing not more than about 8.0 w/o manganese.

7. The alloy set forth in claim 6 containing not more than about 7.5 w/o manganese.

8. The alloy set forth in claim 1 containing not more than about 0.75 w/o silicon.

9. The alloy set forth in claim 1 containing about 19.0–25.0 w/o chromium.

10. The alloy set forth in claim 1 containing not more than about 3.5 w/o vanadium.

11. The alloy set forth in claim 1 wherein %Ni+%Mn is not more than about 16.0 w/o.

12. The alloy set forth in claim 1 wherein C+N is at least about 0.8 w/o.

13. A precipitation strengthenable, austenitic steel alloy that provides a good combination of high temperature strength, corrosion resistance, and wear resistance, said alloy, in weight percent, consisting essentially of about

| | w/o |
|---|---|
| Carbon | 0.35–0.90 |
| Manganese | 3.0–8.5 |
| Silicon | 2.0 max. |
| Phosphorus | 0.05 max. |
| Sulfur | 0.015 max. |
| Chromium | 19.0–25.0 |
| Nickel | 4.5–10.0 |
| Molybdenum | 0.5 max. |
| Vanadium | 0.75–3.5 |
| Boron | 0.015 max. |
| Nitrogen | 0.25–0.85 |
| Tungsten | 0.5 max. |
| Niobium | 0.5 max. |

and the balance essentially Iron, wherein $\%C+\%N \geqq 0.65+0.15(\%V)+0.04[(\%Mo)+0.5(\%W)]$, and $\%C+\%N \leqq 0.65+0.38(\%V)+0.08[(\%Mo)+0.5(\%W)]$.

14. The alloy set forth in claim 13 containing at least about 0.35 w/o nitrogen.

15. The alloy set forth in claim 14 containing not more than about 8.0 w/o manganese.

16. The alloy set forth in claim 15 containing not more than about 7.5 w/o manganese.

17. The alloy set forth in claim 16 containing not more than about 0.75 w/o silicon.

18. The alloy set forth in claim 17 containing not more than about 8.5 w/o nickel.

19. The alloy set forth in claim 18 wherein %Ni+%Mn is not more than about 16.0 w/o.

20. A precipitation strengthenable, austenitic steel alloy that provides a good combination of high temperature strength, corrosion resistance, and wear resistance, said alloy, in weight percent, consisting essentially of about

| | w/o |
|---|---|
| Carbon | 0.40–0.80 |
| Manganese | 3.0–7.5 |
| Silicon | 2.0 max. |
| Phosphorus | 0.05 max. |
| Sulfur | 0.015 max. |
| Chromium | 20.0–24.0 |
| Nickel | 6.0–10.0 |
| Molybdenum | 0.5 max. |
| Vanadium | 1.0–2.5 max. |
| Boron | 0.02 max. |
| Nitrogen | 0.35–0.75 |
| Tungsten | 0.2 max. |
| Niobium | 0.2 max. |

and the balance essentially Iron, wherein $\%C+\%N \geqq 0.65+0.15(\%V)+0.04[(\%Mo)+0.5(\%W)]$, and $\%C+\%N \leqq 0.65+0.38(\%V)+0.08[(\%Mo)+0.5(\%W)]$.

* * * * *